US006164235A

United States Patent [19]

Hoppe

[11] Patent Number: 6,164,235

[45] Date of Patent: Dec. 26, 2000

[54] HYDROFOIL SUPPORTED WATER CRAFT

[75] Inventor: Karl Günter Wilhelm Hoppe, Somerset West, South Africa

[73] Assignee: Universiteit Van Stellenbosch, Cape Province, South Africa

[21] Appl. No.: 09/074,006

[22] Filed: May 6, 1998

[30] Foreign Application Priority Data

May 6, 1997 [ZA] South Africa ..... 97/3436

[51] Int. Cl.[7] ..... B63B 1/26

[52] U.S. Cl. ..... 114/275; 114/280; 114/282

[58] Field of Search ..... 114/274, 275, 114/280, 281, 282, 279

[56] References Cited

U.S. PATENT DOCUMENTS

| | | | |
|---|---|---|---|
| 2,597,048 | 5/1952 | Almqvist et al. | 114/274 |
| 2,703,063 | 3/1955 | Gilruth | 114/280 |
| 3,077,850 | 2/1963 | Beuby | 114/282 |
| 3,092,062 | 6/1963 | Savitsky | 114/280 |
| 3,156,209 | 11/1964 | Ask | 114/275 |
| 3,354,857 | 11/1967 | Hobday | 114/282 |
| 3,561,388 | 2/1971 | Keiper | 114/281 |
| 3,604,384 | 9/1971 | Coles | 114/274 |
| 3,802,366 | 4/1974 | Mankawich | 114/281 |
| 3,804,048 | 4/1974 | Cline | 114/66.5 H |
| 4,582,011 | 4/1986 | Logan | 114/39 |
| 4,606,291 | 8/1986 | Hoppe | 114/274 |
| 4,819,576 | 4/1989 | Shaw | 114/274 |
| 4,962,718 | 10/1990 | Gornstein et al. | 114/274 |
| 5,503,100 | 4/1996 | Shaw | 114/274 |

FOREIGN PATENT DOCUMENTS

| | | |
|---|---|---|
| 0118737 | 3/1984 | European Pat. Off. . |
| 83/3503 | 5/1983 | South Africa . |
| 86/2870 | 4/1986 | South Africa . |
| 661140 | 9/1949 | United Kingdom . |
| 1173335 | 6/1967 | United Kingdom . |
| 93/12967 | 8/1993 | WIPO . |

*Primary Examiner*—Sherman Basinger
*Attorney, Agent, or Firm*—Merchant & Gould P.C.

[57] ABSTRACT

The invention provides a hydrofoil equipment water craft comprising at least one hull member, terminating at a bow and a stern, a front hydrofoil member arranged in the zone of the bow of the hull, at least partially below the hull; and a rear hydrofoil member positioned to the rear of the longitudinal center of gravity (LCG) of the hull, the front hydrofoil member being at least partially offset transversely relative to the rear hydrofoil member so that the front hydrofoil or rear hydrofoil are at least partially disposed in separate longitudinal flow streams.

29 Claims, 9 Drawing Sheets

FIG. 12
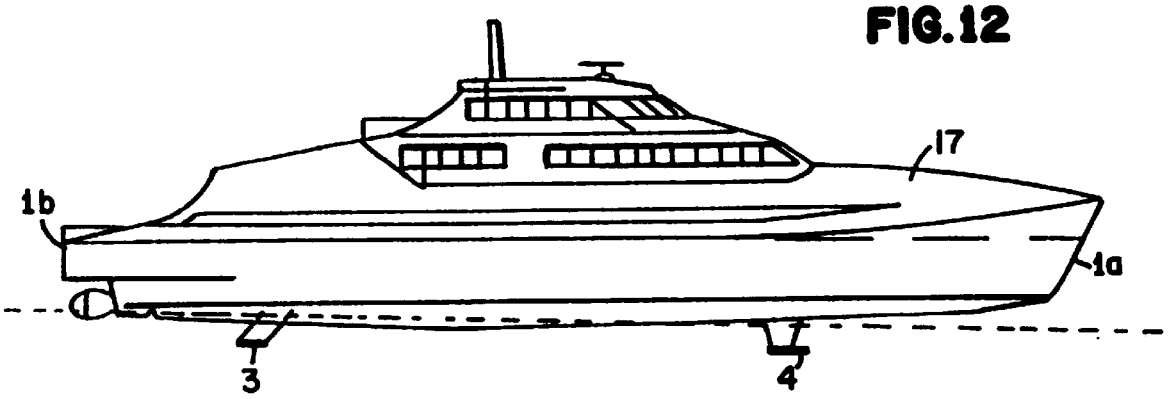
FIG. 13
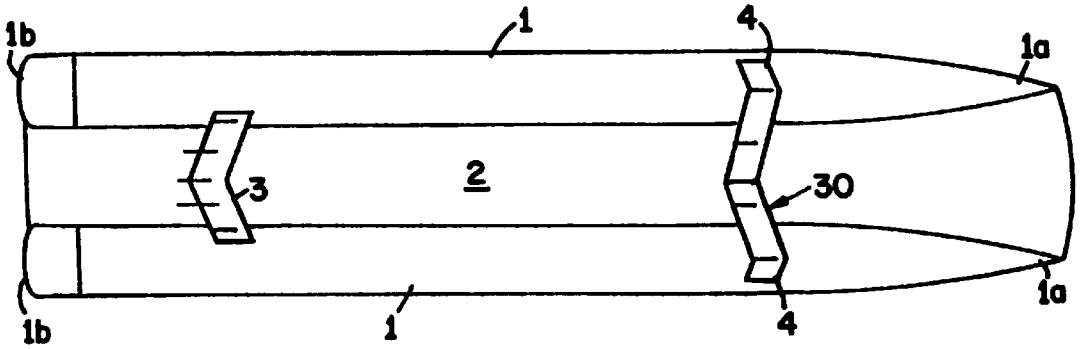
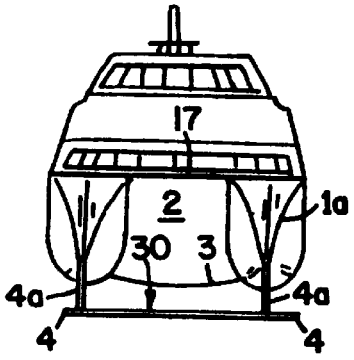
FIG. 14
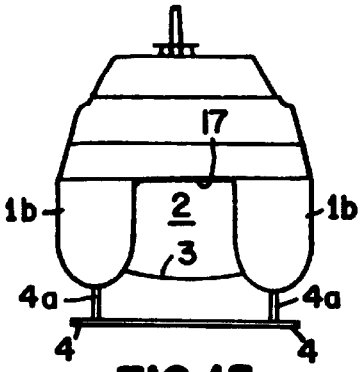
FIG. 15

HYDROFOIL SUPPORTED WATER CRAFT

FIELD OF THE INVENTION

This invention relates to a hydrofoil supported water craft, particularly but not exclusively, a catamaran-type craft.

DESCRIPTION OF PRIOR ART

A hydrofoil supported catamaran is disclosed in South African Patent No. 83/3503 in the name of Buro Vir Meganiese Ingenieurswese van Die Universiteit Van Stellenbosch. In the arrangement disclosed, a hydrofoil member bridges the tunnel formed between two spaced demi-hulls of the craft in a position forward of the longitudinal center of gravity (hereinafter referred to as the LCG) of the craft. Two opposed hydrofoil trim tabs are positioned to the rear of the hydrofoil member and extend partially into the tunnel, one from each hull. The above arrangement is very efficient at design speed, decreasing the drag co efficient by up to 40%. Prior to reaching design speed, both the demi-hulls and the hydrofoils exert a relatively large drag force on the craft, and consequently a relatively large "hump" resistance is encountered.

In South African Patent No. 86/2870 in the name of Universiteit Van Stellenbosch, a different arrangement to that above is disclosed. A transverse hydrofoil member which bridges the demi-hulls of the catamaran, is disposed to the rear of the LCG, while opposed trim foils are provided to the front of the LCG, extending partially into the tunnel from each demi-hull. With this arrangement, the bows of the hulls are initially lifted by the trim foils, which may decrease hull drag. However, by raising the bow of the hull, the angle of attack of the main hydrofoil is changed, affecting its operation. It has also been found by the present Applicant that the trim-foils have the further disadvantageous effect of disturbing water flow over the main rear hydrofoil member, thus introducing a relatively large additional resistance component. Overall, therefore, the gain in hump resistance reduction is very small.

OBJECT OF THE INVENTION

It is accordingly an object of the present invention to provide a novel hydrofoil arrangement for a water craft which will have advantages over the known arrangements, identified above at least under certain conditions. Thus one object of the present invention is to provide a hydrofoil arrangement which it is believed will reduce hump resistance of the craft and also the high speed resistance. It is a further object of the invention to provide a hydrofoil arrangement which will result in reduced wake generation relative to non-hydrofoil supported craft. The invention has the further object of providing a smoother transition between low speed and design speed in rough water, in one embodiment thereof.

SUMMARY OF THE INVENTION

According to the present invention, a hydrofoil equipped water craft comprises at least one hull member, terminating at a bow and a stern, a front hydrofoil member arranged in the zone of the bow of the hull, at least partially below the hull; and a rear hydrofoil member positioned to the rear of the longitudinal center of gravity (LCG) of the hull, the front hydrofoil member being at least partially offset transversely relative to the rear hydrofoil member so that the front hydrofoil or rear hydrofoil are at least partially disposed in separate longitudinal flow streams.

Also according to the invention, a catamaran-type water craft comprises two demi-hull members, each terminating at a bow and a stern, a front hydrofoil member arranged in the zone of the bows of each demi-hull, with at least an outer part of each front hydrofoil being disposed below a demi-hull; and a rear hydrofoil member positioned to the rear of the longitudinal center of gravity (LCG) of the demi-hulls, the front hydrofoil member being at least partially offset transversely relative to the rear hydrofoil member so that at least the outer portion of each front hydrofoil is disposed outside the longitudinal flow steam of the rear hydrofoil.

In a preferred arrangement wherein the craft is a catamaran comprising a pair of demi-hulls which are transversely spaced and connected by upper superstructure to form a tunnel between the hulls, the front hydrofoil will comprise a hydrofoil member positioned below each demi-hull, while the rear hydrofoil will extend between the demi-hulls to bridge the tunnel. With such an arrangement, each front hydrofoil unit will preferably be arranged within the lateral extent of its demi-hull in plan view, but could extend laterally outwardly from the demi-hull if greater hydrofoil is required. Each front hydrofoil member could also extend inwardly into the tunnel between the hulls, and could meet to form a single continuous front hydrofoil extending from below each demi-hull across the tunnel. Such a single front hydrofoil will preferably extent rearwardly in a V-formation in plan view from below in the zone of the tunnel. The portion of the hydrofoil below each demi-hull could likewise be angled rearwardly so that a chevron-like profile in plan view from below is formed. Alternatively, a backward swept front hydrofoil in the form of an inverted V-formation can be used to locate attachment points between the hydrofoil and the semi-hulls more rearwards.

In the case of trimaran craft, and craft with more than three hull structures, selected hull structures, or preferably, each hull structure, will be provided with a front hydrofoil member; and rear hydrofoil members will preferably extend between each or selected tunnels formed between each pair of hull structures.

In an alternative arrangement wherein the craft comprises a mono-hull, the front hydrofoil will preferably be disposed symmetrically below the longitudinally center line of the hull, and the rear hydrofoil will comprise one or more hydrofoil structures extending laterally outwardly, to each side of the hull.

It is envisaged that the front hydrofoil members will be located substantially at or forward of the water line of the bow of the hull. In most instances the front hydrofoil will be positioned to the front of the submerged portion of the bow of the hull at design speed. For craft with a slender hull or hulls, the front hydrofoils could be positioned slightly rearwardly below the submerged portion of the bows at design speed. The front hydrofoils could further be adjustable in respect of depth, angle of attack, and could be movable to an inoperative folded away or retracted position, for example during manoeuvring in a harbour, beaching, etc. It is also envisaged that the front hydrofoils could include one or more rudder structures for bow steering, and could also be employed for purposes of dampening of roll and/or pitch in sea conditions. The front foils could further have several different configurations which are disclosed in more detail below.

DESCRIPTION OF DRAWINGS

Further features of the invention will appear from the embodiments of the invention are described hereunder purely by way of example with reference to the accompanying drawings wherein:

FIGS. 12 to 15 are schematic illustrations of a catamaran having a different front hydrofoil arrangement to that shown in FIGS. 1 to 11; FIG. 12 being a schematic side elevation, FIG. 13 being a schematic plan from below, FIG. 14 being a schematic end elevation from the front, FIG. 15 being a schematic end elevation from the rear; all of a catamaran having a front hydrofoil which extends from below each demi-hull across the tunnel of the catamaran.

DESCRIPTION OF A PREFERRED EMBODIMENT

Figure 1:
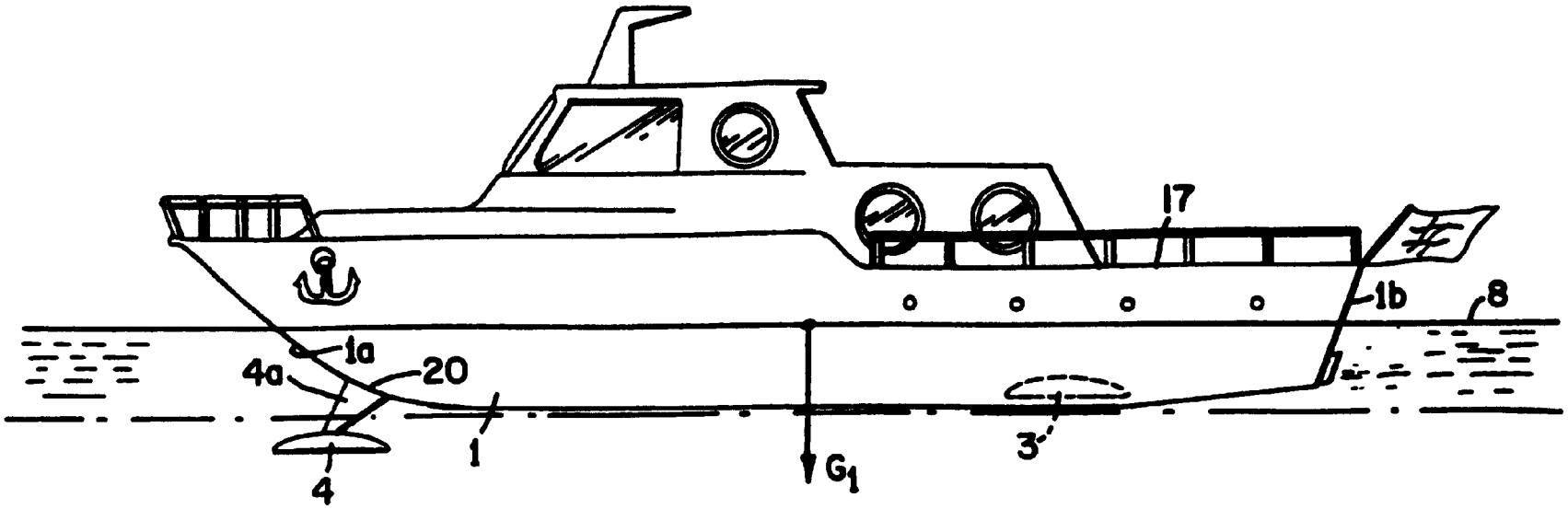
FIG. 1 is a schematic elevation of a catamaran in accordance with the invention at rest.

Referring to the drawings, a catamaran in accordance with the invention comprises a pair of spaced demi-hulls 1 which are coupled together in spaced relationship by means of a super structure 17 so as to define a tunnel 2 with wide walls 2*a,* between the demi-hulls 1 and the super structure 17 for the free passage of water flow.

A rear hydrofoil member 3 which is located between the longitudinal center of gravity (LCG) 15 of the craft and the transoms 1*b* of the demi-hulls 1, bridges the tunnel and is secured to each demi-hull. Preferably the hydrofoil 3 will extend from each demi-hull 1 in a plane which is substantially normal to the hull surface, in order to minimize disturbance of the flow field around each hull 1. In order to achieve such an arrangement therefore, it is envisaged that the hydrofoil 3 may curve or be angled upwardly at its ends in order to meet the hull surface at right angles, FIGS. 7, 8, 10 and 11. It has also been found desirable that any attachment, or the like, not shown, for the hydrofoil will be recessed or otherwise integrally formed with the demi-hulls 1, in order to avoid disturbance of the flow fields around the demi-hulls 1.

It is a feature of the invention that additional front hydrofoils 4 will be provided for each demi-hull 1 at the bow zone 1*a* of each demi-hull 1, such front hydrofoils 4 being arranged in a position which is transversely offset relative to the rear hydrofoil 3. In the arrangement illustrated in FIGS. 1 to 11 therefore, the front hydrofoils 4 will be arranged outside the tunnel 2 on each side thereof. Preferably the hydrofoils 4 will span the width of each demi-hull 1 but may extend outwardly from each demi-hull, FIG. 6, if additional hydrofoil area is required. The hydrofoils 4 could also extend inwardly to bridge the tunnel 2, FIGS. 12 to 15, as described in more detail below.

Various possibilities for the location of the front trim hydrofoil 4 are envisaged. In FIG. 1, the leading edges of the front hydrofoils 4 are positioned directly below the forward termination of the construction water line (the CWL) 8 of the demi-hulls 1 at rest. It is envisaged that in most cases the front hydrofoil 4 will be positioned to the front of the submerged portion of the forward hull portion of the hulls 1 at design speed, FIG. 2. However, for craft with slender hulls 1, or where the hulls 1 are designed to be raised relatively high out of the water, the front hydrofoil 4 could be positioned rearwardly a shown in FIG. 12 below such submerged portion of the forward hull portion of the hulls 1.

It is envisaged that at design speed 80% to 85% of the total mass of the craft will be supported by the front and rear hydrofoils 3, 4. The aggregate of the hydrofoil dynamic forces, will act substantially through the LCG 15. The design trim angle of the craft at speed will preferably be in the order of 1° to 1.5°, FIGS. 2, 3; and the hydrofoils 3, 4, will be designed accordingly. At this design trim angle, all hydrofoils 3, 4, will preferably have the same relative submergence (submerged depth/cord length). Preferably the relative submergence will be approximately between 0.2 to 0.5. It has been found that a hydrofoil supported catamaran in accordance with the invention, will exhibit a relatively lower total resistance since the rear hydrofoil 3 and front trim hydrofoil 4, operate in relatively undisturbed water flow and accordingly, additional drag components due to inclined wake flow of an upstream hydrofoil, are not created. It will be appreciated that depending on design speed, the hydrofoils could be of the sub-cavitating or super-cavitating type.

A craft in accordance with the invention also displays superior characteristics near hump resistance speed. In use, as the craft accelerates from rest, the front hydrofoils 4 create a downstream trough zone, directly below the front zone of each demi-hull 1. The troughs behind the hydrofoils 4 thus create a downward flow which extends rearwardly over the front region of the demi-hulls 1 and results in reduced water forces at such front zone. Accordingly, the trim angle of the craft is reduced which results in a reduction of the pressure resistance component, and a resultant lower hump resistance. It should be noted that it has been found that he pressure resistance component increases with an increase in the trim angle. The water flow around the demi-hulls is therefore reduced, since at least the front portion of each demi-hull is disposed over the troughs downstream from the hydrofoils 4. As a result of the decrease in water flow, the wave making resistance of the hulls is also reduced and also interference between the two demi-hulls 1. The demi-hulls 1, in effect "hang" above the troughs behind the hydrofoils 4, and accordingly have less water contact.

For catamarans having a relatively sharp bow profile, the hydrofoils 4 may be arranged in close proximity to the bow rounding and immediately below the bow rounding. With such an arrangement, the mounting struts 20 of the hydrofoil 4 can be reduced in size in order to reduce the drag of the hydrofoil arrangement itself.

For catamarans with a fuller bow profile, or bulbous bow profile, the hydrofoils 4 are preferably located further upstream relative to the bow 1*a* of the hulls 1. In such a position, the hydrofoils 4 generate a flow and pressure field forward of the demi-hulls 1 which will have an effect similar to that of conventional bulbous bow craft. Thus the waterline length of the flow field is increased and will effectively be greater than the length of the CWL. This feature will result in a reduction in wave making resistance of the craft. Thus, a catamaran in accordance with the invention, can be designed so that a design speed, the front portions of the demi-hulls 1, are free of water contact and the rear zones together with the rear hydrofoil 3, creating a combined pressure field which improves the effective aspect ratio of the rear hydrofoil 3, and results in very low drag thereof. In this regard it should be noted that drag is reduced with an increase in aspect ratio. With such an arrangement the propulsion system in the form of water jets or propellers will remain submerged in all instances at the rear zone of the demi-hulls 1, since both the demi-hulls 1 and the rear hydrofoil 3, will be at about the same level of submergence. For this reason, it is preferred that the lower most level of the rear hydrofoil 3, will be at approximately the same level as the keels of the demi-hulls 1, so that the hulls are not lifted free of the water level, rendering the propulsion ineffective.

Variations of the front trim hydrofoil 4 are doubtless possible and the invention is not in any way limited to the arrangements illustrated. For example, each front hydrofoil 4 could include a movable rudder member, now shown, to permit bow steering of the craft. It is also contemplated that the front hydrofoils 4 could be movably mounted in order to adjust their angle of attack and accordingly the operation of the hydrofoils 4. The depth of the hydrofoils 4 could also be adjustable to adjust the trim of the craft at speed. If required, the entire hydrofoil structures 4 can be mounted so as to be movable or retractable to a stowed position, not shown, for example during manoeuvring in a harbour or in order to permit beaching of the craft.

One arrangement in accordance with the invention is illustrated in FIGS. 12 to 15, wherein the front hydrofoil members 4 project inwardly into the tunnel 4, to meet and thus form a single hydrofoil shown at 30. As shown in FIG. 14, the hydrofoil 30 is substantially horizontally disposed, but forms a V-shape in plan view from below, FIG. 13. Preferably the hydrofoil members 14 will be angled rearwardly so that a chevron-like profile in plan view is defined. A forward sweep of the hydrofoil 30, in the form of an inverted V-shape in plan view is also possible, or alternatively a straight foil. The single extended front hydrofoil 30, shown in FIG. 13, can have a higher aspect ratio than the arrangements shown in FIGS. 7 to 11, which will permit higher loads to be supported and provide for improved efficiencies. The wash created by the extended hydrofoil 30 will also be reduced, since higher aspect ratio foils create lower wash and induced velocities; and the wash will be less turbulent when compared to the two separate hydrofoil members 4, shown in FIGS. 7 to 11, since tip vortices on the inner ends of the hydrofoil members 4 will be eliminated. Moreover the induced downwash which acts to lift the rear foil 3, will be reduced allowing the rear foil to develop a more efficient lift action. Since it is envisaged that the single front hydrofoil member 30 will provide greater lift, the rear foil 3 will be positioned further downstream in order to balance the moments of lift about the LCG. Thus for example, the front hydrofoil member 30 could be positioned a distance of about 20% to 30% of the waterline length L, to the rear of the bow position of L, and the rear hydrofoil 3, disposed at 15%xL from the transom position of L or any other combination of foil positions as long as the resultant lift force of all foils acts approximately through the LCG position of the craft.

The means for mounting the foils 30 and 3 to the demi-hulls could be the same as disclosed above in relation to FIGS. 7 to 11.

Figure 5:
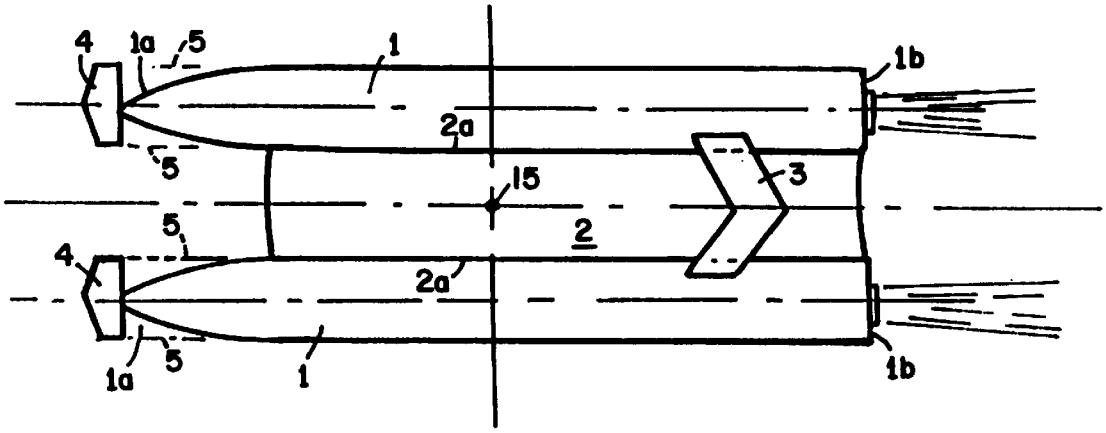
Figure 16:
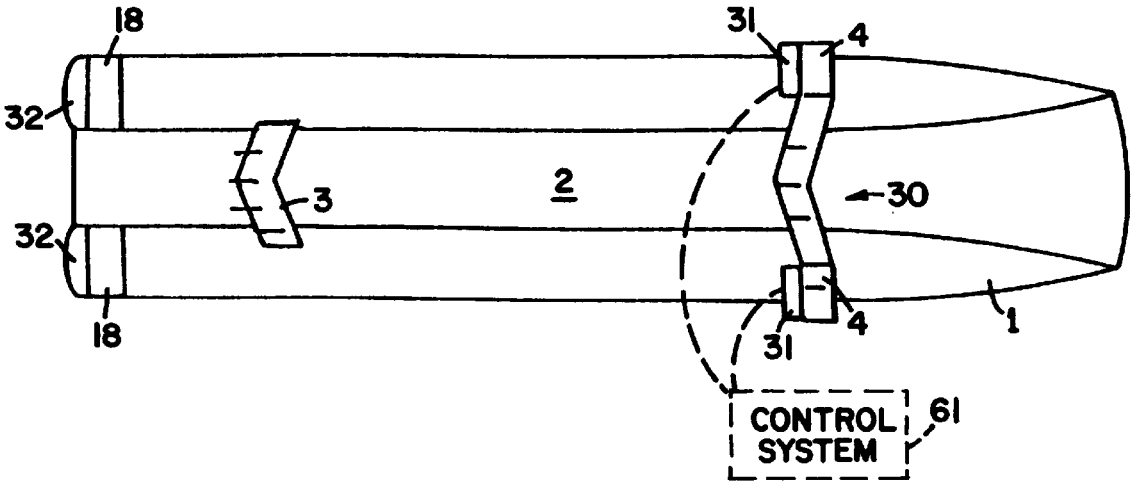
FIG. 16 is a schematic plan from below of a variation of the hydrofoil arrangement shown in FIGS. 12 to 15.

A further arrangement in accordance with the invention is shown in FIG. 16 and comprises a variation of that shown in FIGS. 12 to 15. This variation provides for ailerons to be pivotally mounted behind each hydrofoil member 4 as illustrated. Preferably the ailerons 31 will be positioned within the lateral extent of the demi-hulls 1 in plan view and will not extend into the tunnel 2. The ailerons 31 will be pivotally adjustable in order to vary the angle attack of the hydrofoil members 4 and thus to correct and adjust the trim of the craft transversely and/or longitudinally. For example, such adjustment will enable the craft to be inclined when running in turning circle at speed to bank inwardly to counter-balance the centrifugal action of the hull. The ailerons 31 could also be used as a forward trim foil of a wave-ride-control-system which could be computer operated, either by themselves or in combination with trim tabs 32 provided at the transom 1*b* of each demi-hull. In addition to the trim tabs 32 or in place thereof the rear foil 3 could be rendered adjustable by adjusting its angle of attack or providing trim tabs or ailerons to such rear hydrofoil 3. The rear hydrofoil member 3 itself could take on different configurations. Preferably the hydrofoil 3 will present an angled leading edge to the flow in the tunnel 2, and will accordingly either be angled rearwardly or forwardly in a V-configuration viz. a so-called sweep as shown in FIG. 5. It is also envisaged that the rear hydrofoil 3 could be constituted by two or more smaller hydrofoils arranged in tandem, not shown.

The cross-sectional profile of the hydrofoils 3,4, will be determined in accordance with design speed and operational criteria. Thus, the upper surface of the hydrofoils 3, 4, will be generally convex, while the lower surface will be either linear or concave.

The hydrofoil arrangement of the invention, can also be utilised as an active or semi-active control system for dampening pitch and/or roll of the craft in sea conditions. The front hydrofoils 4, have been found to exhibit a substantial pitch dampening action when the craft runs in waves, which contributes to safe sea-keeping of a craft in accordance with the invention. In an active or semi-active control system for dampening pitch and/or roll of the craft in sea conditions, it is envisaged that the attack angles and/or level submergence of the front hydrofoils can be utilised to counteract wave motions acting on the craft. The front hydrofoils 4 could be used in conjunction with transom flaps, not shown, to provide an effective trim system. By active control is meant that external energy will be applied to the hydrofoils to oppose pitch and/or roll motions. In a semi-active control system, the movements of the front hydrofoils 4 will be damped to oppose the pitch and roll motions of the craft. The optional control system is shown in FIG. 16 at designation 61.

By way of summary therefore, the drawings illustrate and exemplify the following features of the invention:

(i) FIG. 1 shows a semi-displacement catamaran in accordance with the invention at rest, and it will be noted that the demi-hulls 1 are semi-submerged. The float and construction water line (CWL) is shown by numeral 8.

Figure 2:
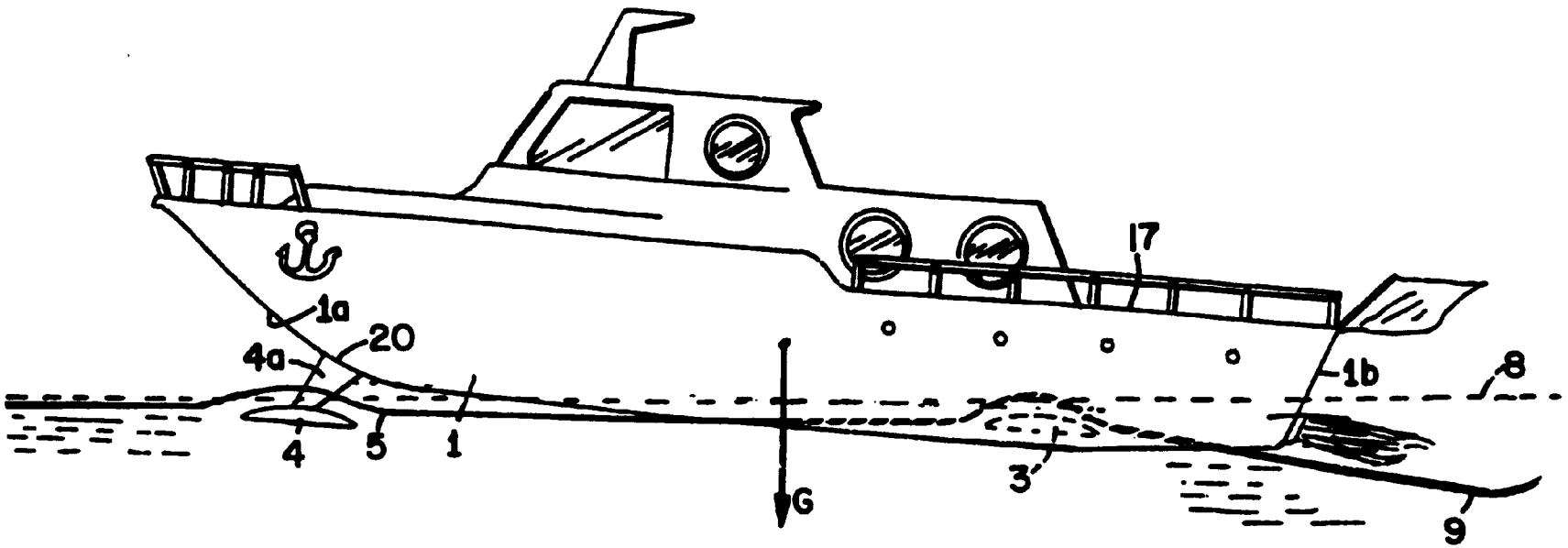
FIG. 2 is a schematic elevation of the catamaran in FIG. 1 at design speed.

(ii) FIG. 2 shows the catamaran with the waterline 9 at design speed, with the hulls 1 lifted partly out of the water and all foils 3, 4, being submerged to the same depth near the water surface 9. The craft exhibits a slightly increased running trim angle relative to the base line or keel line 7. The main weight load of the craft is carried by the hydrofoils 3 and 4.

Figure 3:
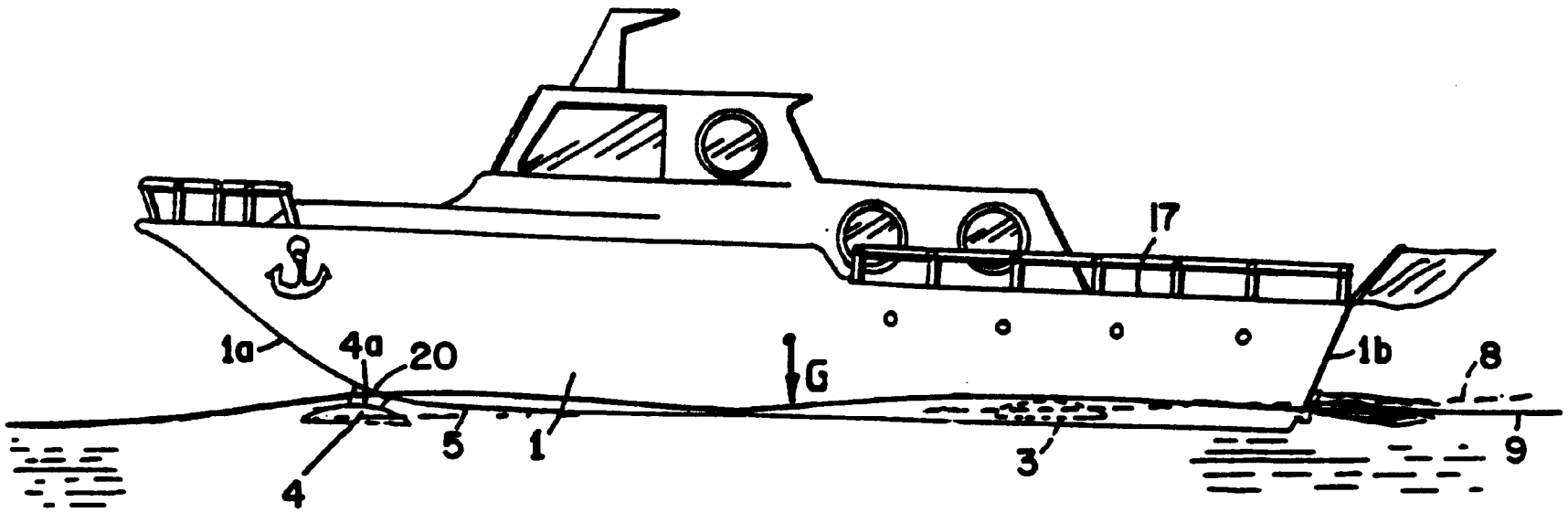
FIG. 3 is a schematic elevation of a catamaran in accordance with the invention, with front hydrofoils located in a different position to the arrangement in FIG. 2 at design speed.

(iii) FIG. 3 shows a similar arrangement as in FIG. 2 but in this embodiment the front hydrofoils 4 are positioned in closer proximity to the demi-hulls 1 and located immediately below the bow rounding 20 in order to reduce the length and size of the struts 4*a* which mount the trimfoils 4, for purposes of reduced resistance, and increased strength and stiffness.

Figure 4:
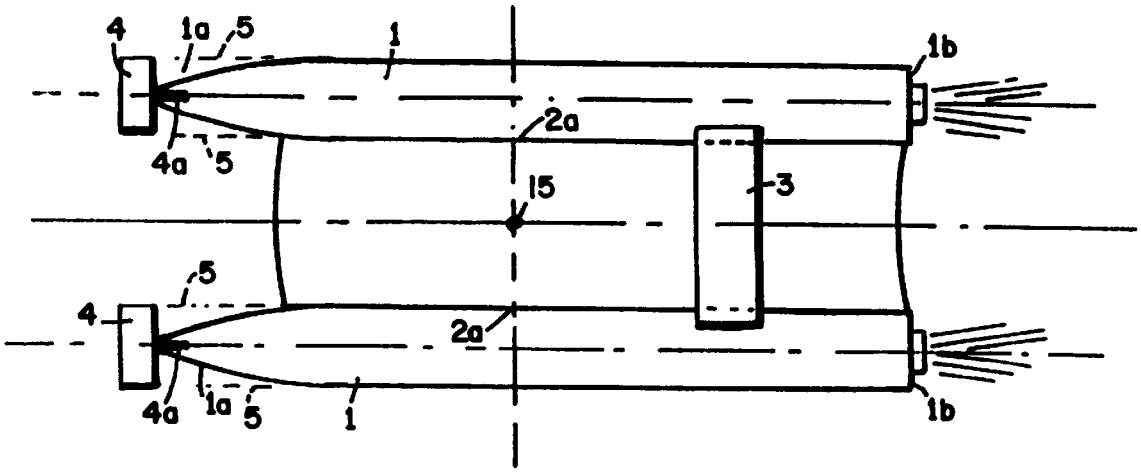
FIGS. 4 to 6 are schematic plan views from below of the catamaran in FIG. 1, with different front hydrofoil and rear hydrofoil configurations, in accordance with the invention.

(iv) FIG. 4 shows a plan view from below of the catamaran 1 illustrating the hydrofoils 3 and 4 and the trough of the wake field 1*a* behind the hydrofoils 4. The demi-hulls 1 thus ride in the wake field 5.

(v) FIG. 5 shows a similar view as FIG. 4 but with the rear hydrofoil 3 being angled rearwardly from each end thereof in a V-shape configuration in plan view from below viz. a so-called sweep. The front hydrofoils 4 have rearwardly angled leading edges which are rounded at their ends.

Figure 6:
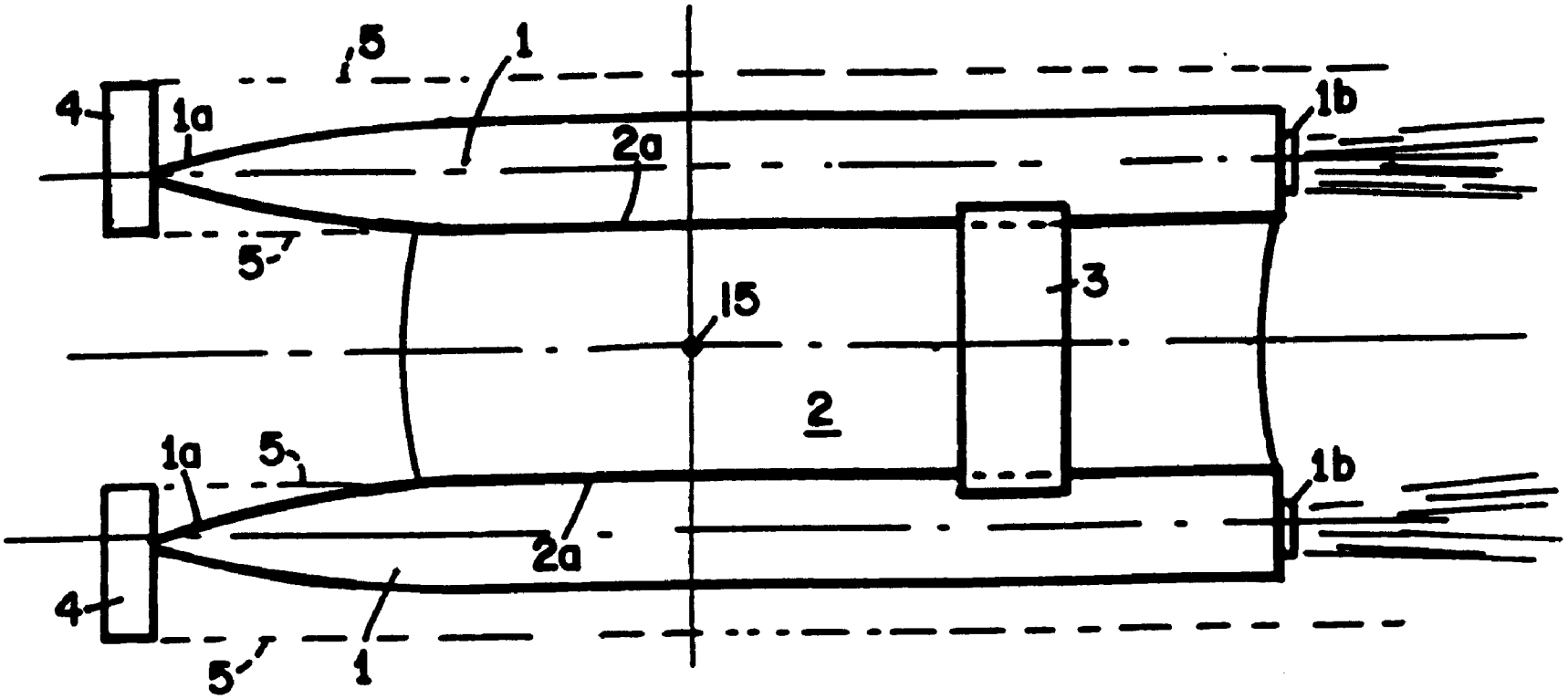

(vi) FIG. 6 is a plan view from below of an arrangement which is similar to that in FIG. 3, but in this instance, the front hydrofoils 4 are longer and asymmetrically located to extend laterally outwardly beyond the outer sides 2 of the hulls 1. The hydrofoils 4 however do not extend into the flow stream of the tunnel 2 so that wake fields of the hydrofoils 4 do not affect the rear hydrofoil 3, down-stream. This arrangement is particularly suitable for sailing boats.

Figure 7:
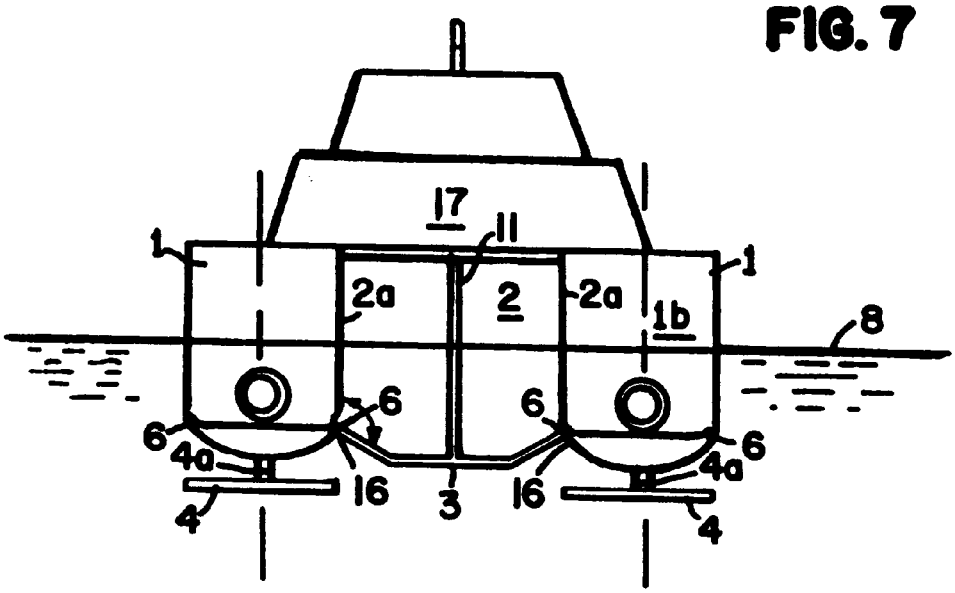
FIGS. 7 to 11 are schematic end elevations of the catamaran in FIG. 1 with different front hydrofoil and rear hydrofoil configurations, in accordance with the invention.

(vii) FIG. 7 is an end elevation from the rear of the craft at rest floating on the CWL 8. The front hydrofoils 4 are positioned below the keels of the demi-hulls 1. The rear hydrofoil 3 slightly higher with similar submergence as the hull bottom. The rear hydrofoil 3 is attached to the tunnel walls 2*a* substantially at right angles to the surface 2*a* of demi-hulls at point 16.

(viii) FIG. 7 further illustrates a vertical central strut 11 to stiffen the rear hydrofoil 3 and to distribute the load at speed between the demi-hulls 1 and the tunnel superstructure 17. The rear hydrofoil 3 is shown with end zones angles upwardly to meet the demi-hulls 1 substantially at a right angle 6. The central zone of the hydrofoil 3 is substantially horizontally disposed at a deeper level.

Figure 8:
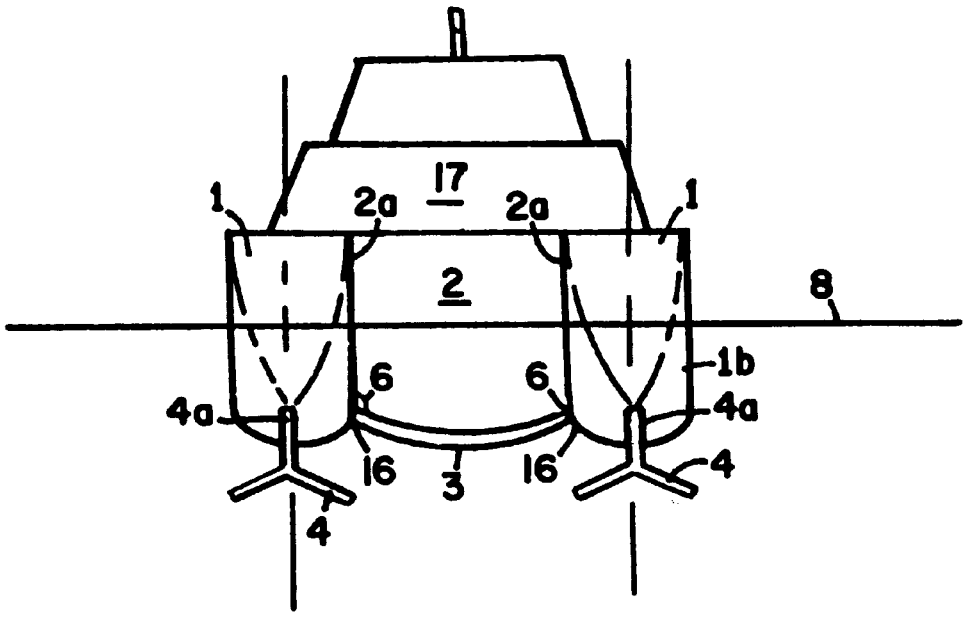

(ix) FIG. 8 shows the catamaran from the front with the front hydrofoils 4 having a negative dihedral construction and secured to the bows by means of struts 4*a*. The rear hydrofoil 3 is curved upwardly to meet the hull surfaces 2*a* at about 90° at 6.

Figure 9:
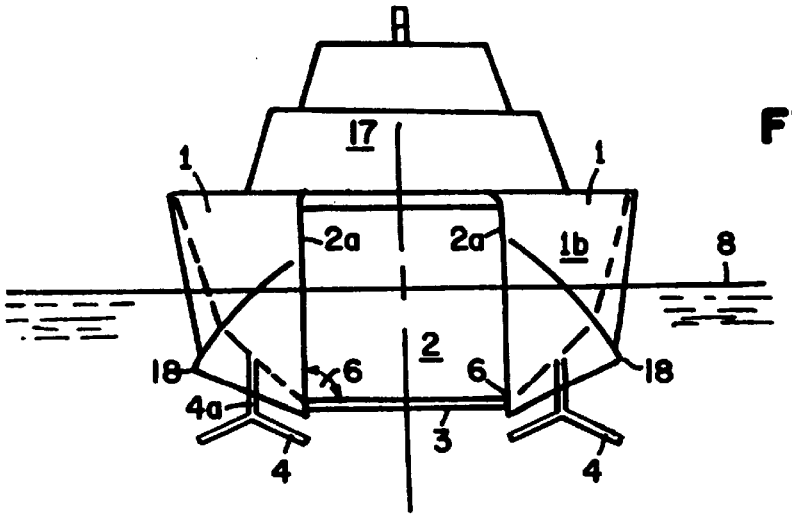

(x) FIG. 9 shows a catamaran 1 with fully asymmetrical demi-hulls 1 and a hard chine 18 planing hull type. The front hydrofoils 4 are as described in paragraph (vii) above. The rear hydrofoil 3 is again at right angles to the hull walls 2*a*. In this case therefore, the rear hydrofoil 3 is horizontal and connected to the keels of the demi-hulls 1.

Figure 10:
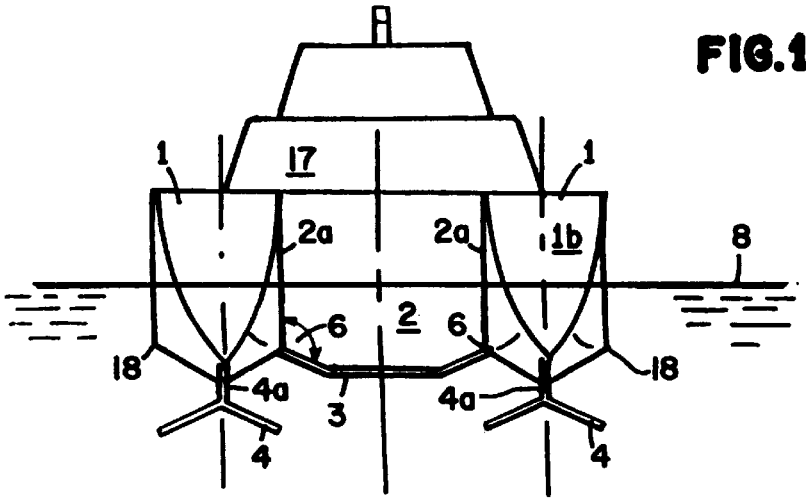

(xi) FIG. 10 shows a similar arrangement to that in FIG. 7 but is applied to hard line 18 symmetrical demi-hulls 1. The rear hydrofoil 3 is connected to the chine edges in the tunnel again at an angle of about 90° to the tangency defined at the junction between the hull wall 2*a* and chine area 18.

Figure 11:
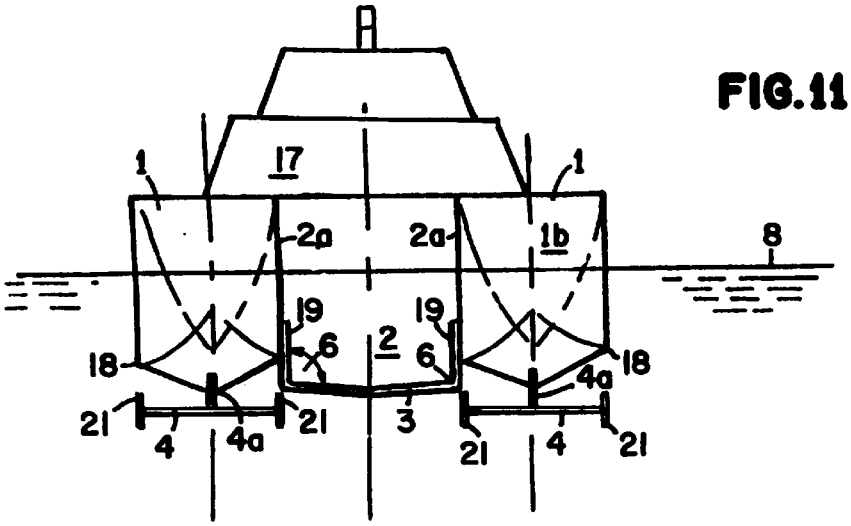

(xii) FIG. 11 shows a catamaran similar to that in FIG. 10 but this instance, the rear hydrofoil 3 has a vertical drop-flange 19 to locate the hydrofoil 3, which is essentially horizontal and has a low dihedral angle, at a lowered position below the demi-hulls 1. The front hydrofoils 4 are provided with end plates 21 for increased lift and efficiency.

(xiii) FIGS. 12 to 15 show a catamaran which differs from those above in that the front hydrofoil members 3 extend inwardly into the tunnel 2 to meet and thus to form a single front hydrofoil member which extends from below each demi-hull 1, across the tunnel 2. The advantages of this arrangement have been described above.

(xiv) FIG. 16 shows a variation of the catamaran in FIGS. 12 to 15 in that the front hydrofoil members 4 are provided with rearwardly extending trim ailerons 31 which will be adjustable to vary the lift forces of the hydrofoil 30. The craft illustrated is also provided with rear trim tabs 32 which are adjustable and disposed at the transom of each hull.

The invention will find application with catamarans having symmetrical, semi-asymmetrical or fully asymmetrical demi-hulls. These different catamaran types are for example illustrated in FIGS. 7 to 11. In all cases it is preferred that the rear hydrofoil will meet the hull surface of a demi-hull at approximately right angles as described above.

Doubtless many variations of the invention exist without departing from the principles set out in the consistory clauses. For example, the invention has been described above in relation to catamaran-type craft, but will also find application for other multi-hull crafts such as trimarans, as well as mono-hull craft.

What is claimed is:

1. A hydrofoil equipped water craft having at least one hull member, terminating at a bow and a stern, and a hydrofoil system whereby the hull is raised at the design speed of the craft so that at least a portion of the stern of the hull remains partially submerged comprising:

a front hydrofoil member positioned adjacent the bow of the hull, below the hull;

a rear hydrofoil member positioned to the rear of the longitudinal center of gravity (LCG) of the craft;

the rear hydrofoil member being disposed at least partially above the level of the front hydrofoil and at such a level that it is unable to lift the portion of the stern of the hull free of the water; and the front hydrofoil member being at least partially offset transversely relative to the rear hydrofoil member so that the front hydrofoil member or rear hydrofoil member are at least partially disposed in separate longitudinal flow streams.

2. A hydrofoil equipped, catamaran-type water craft comprising:

two demi-hull members each terminating at a bow and a stern;

a front hydrofoil member arranged adjacent the bow of each demi-hull, with at least an outwardly directed portion of each front hydrofoil member being disposed below an associated demi-hull;

a rear hydrofoil member positioned to the rear of the longitudinal center of gravity (LCG) of the demi-hulls, the front hydrofoil members being at least partially offset transversely relative to the rear hydrofoil member so that at least the outwardly directed portion of each front hydrofoil is disposed outside the longitudinal flow stream of the rear hydrofoil; and wherein the rear hydrofoil member is disposed at least partially above the level of the front hydrofoil members and at such a level that it is unable to lift the portion of the sterns of the hulls free of the water.

3. The craft according to claim 2 wherein the craft is a catamaran comprising a pair of demi-hulls which are transversely spaced and connected by an upper super-structure to form a tunnel between the hulls, the front hydrofoil comprises a hydrofoil member positioned below each demi-hull, while the rear hydrofoil extends between the demi-hulls to bridge the tunnel.

4. The craft according to claim 3 wherein each front hydrofoil member extends inwardly into the tunnel between the demi-hulls, and such hydrofoil members meet to form a continuous front hydrofoil extending from below each demi-hull across the tunnel.

5. The craft according to claim 4 wherein the continuous front hydrofoil extends rearwardly in a V-formation in plan view, in the zone of the tunnel.

6. The craft according to claim 5 wherein the portion of the continuous front hydrofoil below each demi-hull is angled rearwardly so that the front hydrofoil defines a chevron-like profile in plan view.

7. The craft according to claim 4 wherein the continuous front hydrofoil extends frontwardly in an inverted V-formation in plan view, in the zone of the tunnel.

8. The craft according to claim 2 wherein each front hydrofoil member is located below its demi-hull, within the lateral extent thereof in plan view.

9. The craft according to claim 2 wherein each front hydrofoil member extends from below its demi-hull from within the lateral extent thereof in plan view, and extends laterally outwardly from the demi-hull.

10. The craft according to claim 2 wherein the front hydrofoil members below each demi-hull are located substantially at or forward of the design water line at the bows of the hulls.

11. The craft according to claim 2 wherein the front hydrofoil members are positioned to the front of the submerged portion of the hulls at design speed.

12. The craft according to claim 2 wherein the front hydrofoil members are positioned directly below the submerged portions of the bows of the hulls at design speed.

13. The craft according to claim 2 wherein the front hydrofoil members are adjustable in respect to depth.

14. The craft according to claim 2 wherein the front hydrofoil members are adjustable in respect of angle of attack.

15. The craft according to claim 2 wherein the front hydrofoil members are movable to an inoperative folded away or retracted position.

16. The craft according to claim 2 wherein the front hydrofoil members are provided with adjustable ailerons.

17. The craft according to claim 16 wherein the ailerons are located within the lateral extent in plan view of the bows of the craft.

18. The craft according to claim 2 wherein all or selected hulls of the craft are provided with rearwardly extending trim tabs located at the transom of the hulls.

19. The craft according to claims 1 or 2 including an active or semi-active control system for dampening pitch and/or roll of the craft in sea conditions by utilizing the attack angles and/or level submergence of the hydrofoils to counteract wave motions acting on the craft.

20. The hydrofoil equipped watercraft of claim 1, wherein the front foil is disposed below the hull to create a down wash and thereby to form a water flow trough below the hull at the design speed of the craft.

21. The hydrofoil equipped watercraft of claim 1, wherein 80–85% of the total mass of the craft is supported by said hydrofoil system.

22. The craft according to claim 2, wherein the rear hydrofoil member extends from each demi-hull in a plane which is substantially normal to such demi-hull.

23. The craft according to claim 1, wherein the front hydrofoil member terminates in outwardly directed portions and tip vortices-produced by the outwardly directed portions do not pass over the rear hydrofoil member at design speed.

24. The craft according to claim 1, wherein the front hydrofoil member is adjustable in respect of depth.

25. The craft according to claim 1, wherein the front hydrofoil member is adjustable in respect of angle of attack.

26. The craft according to claim 1, wherein the front hydrofoil member is movable to an inoperative folded away or retracted position.

27. The craft according to claim 1, wherein the front hydrofoil member is provided with an adjustable aileron.

28. The craft according to claim 27, wherein the aileron is located within the lateral extent in plan view of the bow of the craft.

29. The craft according to claim 1, wherein the hull of the craft is provided with a rearwardly extending trim tab located at the transom of the hull.

* * * * *